United States Patent [19]

Springett et al.

[11] 4,056,723

[45] Nov. 1, 1977

[54] ROTATABLE CORONA DEVICE

[75] Inventors: Brian E. Springett; Dror Sarid, both of Rochester, N.Y.

[73] Assignee: Xerox Corporation, Stamford, Conn.

[21] Appl. No.: 651,768

[22] Filed: Jan. 23, 1976

[51] Int. Cl.[2] ..... H01T 19/00

[52] U.S. Cl. ..... 250/324; 250/326

[58] Field of Search ..... 250/324, 325, 326; 317/262 A

[56] References Cited

U.S. PATENT DOCUMENTS

| | | | |
|---|---|---|---|
| 3,385,966 | 5/1968 | Rosenthal | 250/325 |
| 3,482,092 | 12/1969 | Luckey et al. | 250/324 |
| 3,958,162 | 5/1976 | Kuehnle | 250/326 |

*Primary Examiner*—Alfred E. Smith
*Assistant Examiner*—T. N. Grigsby

[57] ABSTRACT

A corona charging arrangement comprising a plurality of charging devices formed onto a unit. Each of the devices is rotatable to an operative position in which it is coupled to suitable terminals for applying energizing potential thereto, the operative position being selected so that charge therefrom is deposited on the imaging surface.

5 Claims, 3 Drawing Figures

ROTATABLE CORONA DEVICE

BACKGROUND OF THE INVENTION

The present invention relates to a corona charging device for depositing charge on an adjacent surface. More particularly, it is directed to a corona charging arrangement usable in a xerographic reproduction system for generating a flow of ions onto an adjacent imaging surface for altering or changing the electrostatic charge thereon.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior, during and after deposition of toner thereon to improve the quality of the xerographic copy produced thereby. Both d.c. and a.c. type corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating d.c. voltage. The wire is partially surrounded by a conductive shield which is usually electrically grounded. The surface to be charged is spaced from the wire on the side opposite the shield and is mounted on a grounded substrate. Alternatively, a corona device of the above type may be biased in a manner taught in U.S. Pat. No. 2,879,295 wherein an a.c. corona generating potential is applied to the conductive wire electrode and a d.c. potential is applied to the conductive shield partially surrounding the electrode to regulate the flow of ions from the electrode to the surface to be charged. Other biasing arrangements are known in the prior art and will not be discussed in great detail herein.

A problem associated with conventional corona discharge devices employing a conductive wire is a result of the fact that corona glow is associated with a region of high chemical reactivity where chemical compounds are synthesized from machine air, which results in chemical growths being built up on the surface of the wire. These chemical growths after a prolong period of operation degrade the performance of the corona device. Since free oxygen and ozone are produced in the corona region the corona electrode must of necessity be highly oxidation resistant. The above problem of chemical growth build-up on the wire has been addressed by the provision of wire materials which are less subject to chemical attack. While this has reduced the problem, such materials have substantially increased the cost of corona devices.

A still further problem associated with corona discharge devices operating in a xerographic environment results from toner accumulation on the surface of the corona electrode. The spots of accumulated toner, being dielectric in nature, tend to cause localized charge build up on the interior surfaces of the shield which produces current nonuniformity and reduction in corona current. Localized toner accumulations on the insulating end blocks which support the wire electrode also cause sparking. A corona charging device which alleviates the above-noted problems has been disclosed in application Ser. No. 651,769 in the joint names of D. Sarid and B. Springett entitled Compact Corona Charging Device filed concurrently herewith. The invention is directed to a new arrangement incorporating as a part thereof several charging devices constructed in accordance with the above application.

Notwithstanding, the improved results obtained by employing a corona device according to the aforementioned application, the latter two problems, degradation of the coronode surface and contamination of the shield may still require that the corona device be periodically cleaned and if necessary, replaced. The process of replacing corona devices is, of course, an expensive and time consuming procedure which requires the presence of a trained technician. Normally, the worn wire electrode is removed from the corona device and replaced by a new wire. Alternatively, the entire unit is removed, with the shield being cleaned with an abrasive material to remove dirt and toner accumulations.

It would, therefore, be desireable to facilitate replacement of contaminated corona devices in electrophotographic machines with new ones.

OBJECTS AND SUMMARY OF THE INVENTION

This invention has as its primary object the provision of a corona device for use in xerographic reproduction machines which overcomes or reduces the problems outlined above by providing a plurality of corona device in a single unit, each device being movable at will into a position for depositing charge on an imaging surface.

A further object is to provide an arrangement for easily replacing a spent corona device with a new device.

A further object is to provide a corona arrangement having a plurality of corona generators mounted as a unit, only one of which is positioned and coupled to energizing potentials to deposit charge on the imaging surface, but the remainder of which may be alternately moved or rotated to an operative position without removal of the old unit from the machine.

A further object is to provide a multi-corona generator unit, each unit corresponding to a corona device of the type disclosed in application Ser. No. 651,769 refered to hereinbefore.

These and other objects are accomplished by means of a corona charging arrangement comprising a plurality of charging devices formed onto a unit. Each of the devices is rotatable to an operative position in which it is coupled to suitable terminals for applying energizing potential thereto, the operative position being selected so that charge therefrom is deposited on the imaging surface.

DESCRIPTION OF THE PREFERRED EMBODIMENT

Figure 1:
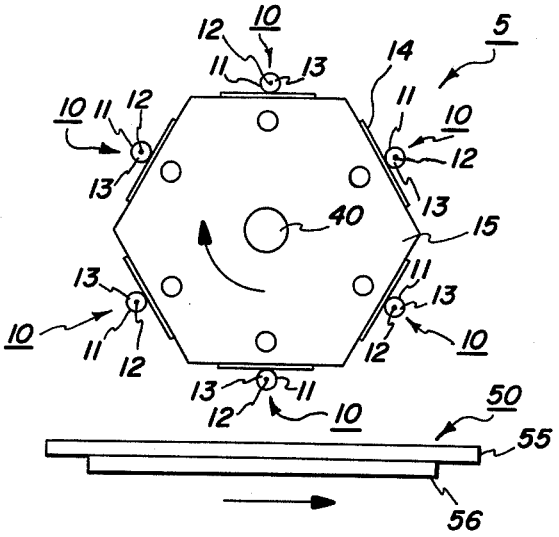
FIG. 1 is an illustrative cross-section of the corona discharge arrangement according to the invention.
Figure 2:
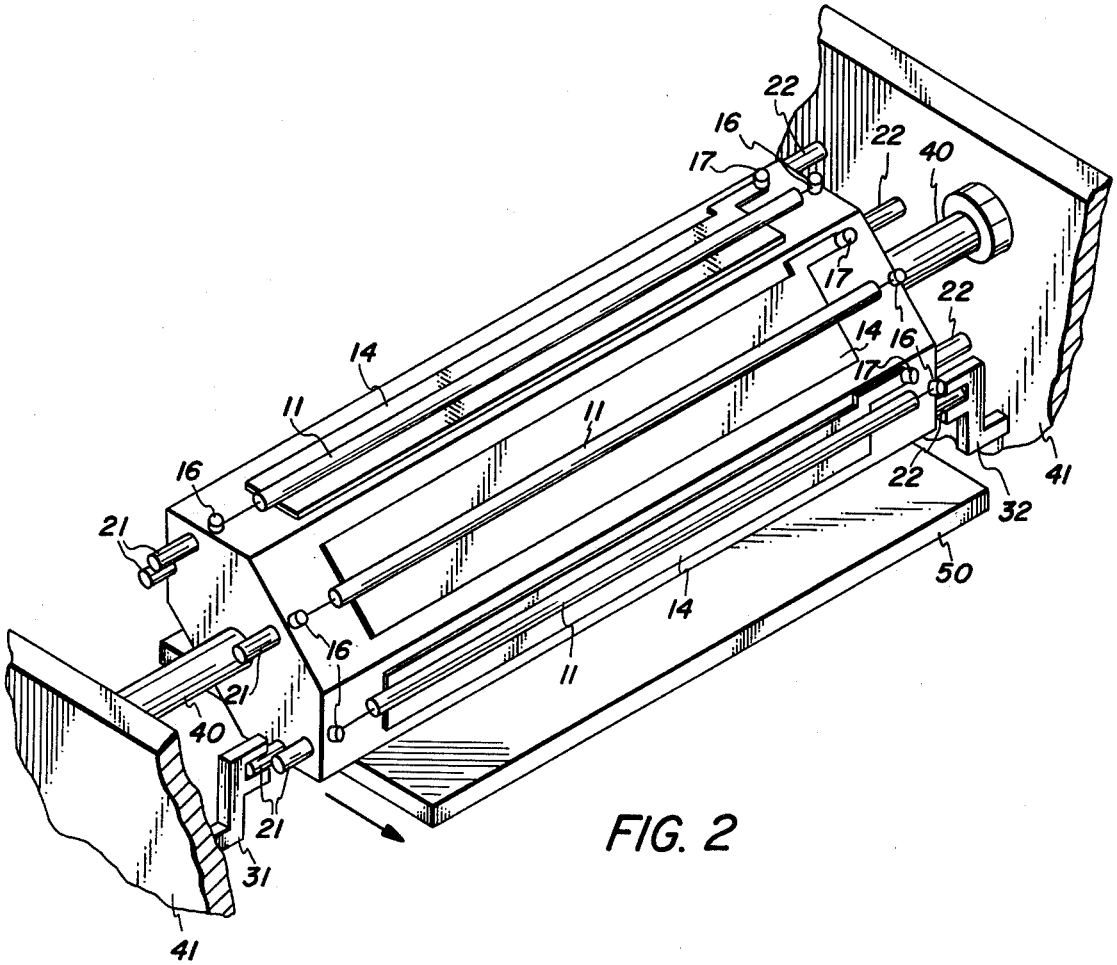
FIG. 2 is a perspective view of the invention.

Referring to the drawings, the corona charging arrangement 5 of the invention is illustrated as being supported adjacent to an imaging member 50 of a conventional xerographic reproduction machine. The details of construction of the imaging member 50 are well known in the art and do not form a part of this invention. Briefly, however, the imaging member 50 conventionally comprises a photoconductive surface 55 carried by a conductive substrate 56. During operation of the xerographic system, the conductive substrate 56 is held at a reference potential, usually machine ground. During a typical cycle of a xerographic reproduction machine, the imaging member 50 is moved relative to a plurality of corona devices and is subjected several times for diverse purposes to charge depositions by these corona devices, as is well known in the art.

The corona charging arrangement 5 of the invention comprises a plurality of charging devices 10 of the type disclosed in application Ser. No. 651,769, Compact Corona Charging Device, in the joint names of D. Sarid and B. Springett, entitled "Compact Corona Charging Device", filed concurrently herewith. Each of the devices 11 is supported on a polygonal or multisided dielectric block 15 mounted on an axle 40 journalled for rotation in side frame members 41. A suitable drive means (not shown) may be coupled to the axle for rotating the block 15. The rotation drive means may, for example, be a motor coupled to the axle 40 by a suitable drive linkage. The motor may be activated either manually by operating a push button or switch or automatically by a suitable logic circuit after a preselected number of copies have been made by the machine. An alternative means for a rotating the block 15 could comprise a removeable crank which keys into one end of the axle and is operable from outside of the machine by an operator or technician.

Each of the corona devices 10, as disclosed in greater detail in the aforementioned concurrently filed application, includes a coronode or corona discharge electrode 11 in the form of a conductive wire 12 having a relatively thick dielectric coating 13. The wire 12 and coating 13 are shown as having circular cross section, but other cross sections, such as square or rectangular, may be used satisfactorily. The electrode 11 is supported at its opposite ends by conductive posts 16 to which the ends of the wire 12 are attached. One of the posts 6 is electrically coupled by any suitable means to a terminal 21 which projects or extends away from the block 15 in a direction parallel to the electrode 11. The electrical connection between the post 16 and the terminal 21 may be by means of a surface carried wire, by a conductor embedded in the block 15 or by any other conventional means.

The coronode 11 is supported in contact with a conductive biasing member or shield 14, the member 14 being attached to, deposited on or carried by the dielectric support block 15. The member 14 may take the form of a thin sheet of metal or a metal plate carried by one of the flat outer surfaces of the block 15. The member 14 includes an exposed flat surface facing and in contact with the coronode 11 and is in electrical communication by any suitable means with a terminal 22 which projects or extends away from the block 15 in a direction parallel to the axis of the eletrode 1 on the side of the block 15 opposite the terminal 21. The conductive coupling between the shield 14 and the terminal 22 may be via an intermediate post 17 partly embedded in the dielectric block 15 or any other suitable means. All portions of the terminals 16, 17, 21 and 22 and wire 12 outside of the corona discharge region are preferably coated with a thick dielectric or insulating material to prevent arcing to adjacent surfaces.

It is seen that the dielectric block 15 serves to provide a rigid support for both the electrode 11 and the conductive member 14. The imaging surface 50 is arranged on the side of the electrode 11 opposite the conductive member 14 and support block 15.

Only the corona device 10 which is juxtaposed to the imaging surface 50 is operative at any given time for depositing charge on the surface 50. This is effected by means of snap type or flexible electrical connectors 31 and 32 which are supported by, but electrically insulated from the opposite sides 41 of the frame. Snap connector 31 operates to abut or contact the terminal 21 which, in turn, is in conductive communication with the wire 12. Connector 32, in similar fashion, operates to contact the terminal 22 which, in turn, is conductively coupled to the shield 14. Thus, as the block 15 is rotated, successive devices 11 are electrically coupled to an electrical energizing arrangement with the connectors 31 and 32.

The wire 12 of each of the devices 11 may be made of any conventional conductive filiment material such as stainless steel, gold, aluminum, copper, tungsten, platinum or the like. The diameter of the wire 11 is not critical and may vary typically between 0.5 – 15 mils. and preferably is about 3–6 mils.

Any suitable dielectric material may be employed as the coating 13 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment, and ion bombardment.

The thickness of the dielectric coating 13 used in the corona device of the invention is such that substantially no conduction current or d.c. charging current is permitted therethrough. Typically, the thickness is such that the combined wire and dielectric diameter falls in the range from 3.5 – 50 mil with typical thickness of the dielectric of 1.5 – 25 mil with sufficiently high dielectric breakdown strengths. Several commercially available glasses have been found by experiment to perform satisfactorily as the dielectric coating material. The glass coating selected should be free of voids and inclusions and make good contact with or wet the wire on which it is deposited. Other possible coatings are ceramic materials such as Alunima, Zirconia, Boron Nitride, Beryllium Oxide and Silicon Nitride. Organic dielectrics which are sufficiently stable in corona may also be used.

The biasing member or shield 14 has been shown as being flat and rectangular in shape. Different shapes may be employed with satisfactory results.

The snap connectors 31 and 32 have been illustrated as being generally U-shaped at the portion thereof which makes contact with the terminals 21 and 22. The legs of the U may be flexible or resilient so that the terminals are positively grasped to make the appropriate electrical connections. Various other types of connectors would obviously suggest themselves to those skilled in the art.

Typical dimensions and construction details for a device according to FIG. 1 of this invention are as follows:

| Element | Dimensions | Material |
|---|---|---|
| Rectangular flat surfaces of substrate or block 15 | 3 × 45 cms | Lucite or other insulating material |
| Shield 14 | $1 \times 2.5 \times 10^{-3} \times$ 40 cms | Aluminum, Nickel or other easily evaporated metal |
| Wire 12 | O.D. = $7.5 \times 10^{-3} \times$ 45 cms long | Same as for shield or Tungsten wire |
| Dielectric Coating 13 | O.D. = $7.5 \times 10^{-2} \times$ 45 cms long | Glass or other evaporable or coatable dielectric |

The details of the construction of the corona device 10 and electrical energization schemes for proper operation thereof are described in greater detail in application Ser. No. 595,656, in the names of F. Davis and G. Safford and that of the aforementioned concurrently filed application Ser. No. 651,769, and. the disclosures of those applications are hereby incorporated into this application by reference. Briefly, however, referring to FIG. 3 an a.c. voltage source 18 is connected between the substrate 56 and the corona wire 12 of the operative corona device 11 via connector 31, the value of the a.c. potential being selected to generate a corona discharge adjacent the associated electrode 11. The frequency of the a.c. source 18 may be varied widely in the range from 60 hz. commercial source to several megahertz. The device has been operated and tested at 4 KHz. and also found to operate satisfactorily under conditions typical of the xerographic process in the range between 1 KHz and 50 KHz.

The biasing member or shield 14 operates to control the magnitude and polarity of charge delivered to the surface 50. To that end, the connector 32 is coupled to a switch 22 which, depending on its position, permits the corona device 10, located opposite the surface 50, to be operated in either a charge neutralizing mode or a charge deposition mode. With the switch 22 in the position shown, the member 14 of the corona device is coupled to ground via a lead 24. In this position, no d.c. electric field is generated between the biasing member 14 and the surface 50 and the device 10 operates to inherently neutralize any charge present on the surface 14. This is a result of the fact that no net d.c. charging current passes through the electrode 11 by virtue of the thick dielectric coating.

The operation of the corona device of this invention in the neutralizing mode is the same as the operation of the devices disclosed in Ser. No. 595,656 and the aforementioned application Ser. No. 651,769 and has the same desireable property of delivering no net d.c. charging current to an adjacent surface when that surface is held at the same potential as the biasing member or shield. The reason for this property, as was discussed in greater detail in the aforementioned application, is that the thick dielectric coating on the wire takes on a net charge to compensate for greater mobility of negative charges. This net charge forces the corona device to deposit equal positive and negative charges onto the charge collecting surface over each a.c. cycle. In the device of this invention, this charge build-up also operates to hold the electrode 11 in tight contact with the shield 14.

Thus, a surface such as 55 will be completely neutralized by the corona device 10 (with switch 22 in the solid line position) if permitted to stay in charge receiving relationship therewith for a sufficient period of time.

Figure 3:
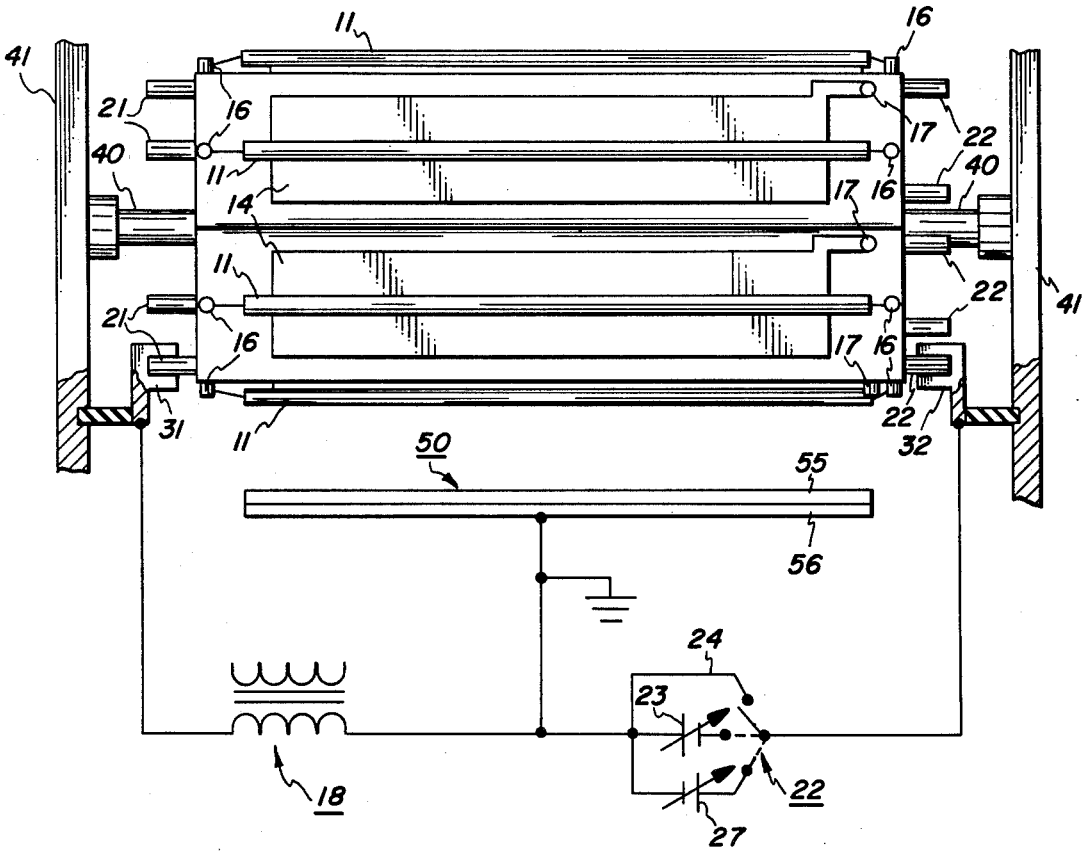
FIG. 3 is a side elevational view.

The operation of the corona device of the invention to deposit a specific net charge on an imaging surface is accomplished by moving switch 52, FIG. 3, to either of the positions shown in dotted lines, whereby a variable d.c. potential of either positive or negative polarity with respect to the surface 56 may be applied to the shield member 14.

With the switch 52 operated to couple source 23 to the shield 14, the potential between the shield 14 and the conductive plate 56, $V_{sp}$, is negative, and, associated with this potential, is a d.c. electric field of a first sense in the space between the member 14 and the surface 50. With the switch 22 operated to couple source 27 to a shield 14, $V_{sp}$ is positive. This latter situation results in a d.c. electric field of a second sense between the member 14 and the surface 50. With $V_{sp}$ positive (source 27 connected to shield 14) charging current from the corona device is positive and increases slowly and linearly at low values of $V_{sp}$ then increases exponentially at higher values of $V_{sp}$. A similar rise in negative charging current $I_p$ is noted when the source 23 is coupled to the shield 14 and its value increases progressively in the negative direction. A more precise description of the above characteristics of the charging devices 10 of the invention may be had by reference to the aforementioned application.

The exponential rise in charging current, $I_p$, as a function of increasing bias potential from shield 14 to substrate 56, $V_{sp}$, is an obvious advantage in situations where rapid charging of a photoreceptor is desireable, as in the initial charging of a photoreceptor in the xerographic process. As the process speeds of xerographic systems rise, the ability to deposit such high levels of charging current is extremely important.

The final value of the potential to which collecting surface 55 is brought by the corona device of the invention is equal in magnitude and polarity to the potential, $V_{sp}$, between the shield 14 and surface 50. Thus, if the switch 52 of FIG. 1 were connected to apply a positive potential of +X volts to the shield, the imaging surface 55 would be charged to a potential of X volts (assuming a long enough exposure time). If the shield is biased with a voltage of −X volts, the surface 15 charges toward a final voltage of −X volts. When the surface to be charged reaches a potential which is equal to that applied to the shield, no further charging current is drawn and the charge on the surface remains unchanged thereafter.

The operation of the shield bias voltage $V_{sp}$ in determining the final net charge on an adjacent surface may be understood from the following explanation. Assume initially that both the shield 14 and the surface to be charged 55 are at ground potential ($V_{sp}=0$). Under these conditions, although the corona discharge continuously produces positive ions, negative ions, and electrons, there is no appreciable net current to either the shield or the charge receptor. This is true because on the negative half cycle of the a.c. potential applied to the coronode, the shield recieves almost all the negative charge, while on the succeeding positive half cycle, an equal amount of positive charge is delivered to the shield. This condition, as explained previously, is a consequence of the thick dielectric coating which does not permit a net d.c. coronode current. Without a dielectric coating, a net current would occur, since the positive and negative charge carriers have different mobilities.

In the present invention, the surface of the dielectric coating acquires a net charge which just counterbalances the effect of the difference in mobilities. This action is inherent in the device, and the surface charge will automatically adjust to the proper value, even compensating for changes in humidity, temperature, pressure, and other variations in gas properties to which the device might be subjected. Thus, where $V_{sp}=0$, any charge carried by the surface 55 will be reduced to zero. If the surface is neutralized to begin with, it will remain so.

When a voltage $V_{sp}$ is applied to the shield, an electric field is generated between the shield and the surface to be charged. This electric field separates the positive and negative charges and drives them to the respective surfaces. Positive charges move to the negatively biased surface and negative charges move to the positively charged surface. With the shield biased positively with respect to the charge receptor surface, a significant fraction of the positive ions adjacent the wire is directed toward the charge receptor surface on the positive half cycle of the potential applied to the coronode. Similarly, on the negative half cycle, an insignificant fraction of negative charges is directed toward the charge receptor surface. These combined actions result in a net d.c. current to the charge receptor surface, and an equal and opposite current to the shield. This process continues until the surface 55 reaches the shield potential, and $V_{sp}$ is reduced to zero. The converse of the above-noted action takes place when a negative potential is applied to the shield with respect to the charge receptor surface via conductive plate 56.

In operation, the charging arrangement 5 of the invention is initially located as shown in the drawings with the block 15 rotated to a position such that one of the corona devices 10 is coupled to the corona energizing potentials via connectors 31 and 32. More specifically, the lowermost device 10, as seen in FIG. 3, would be the operative device and, when in this position, would have its wire terminal 21 coupled to the a.c. source via connector 31. Likewise, its shield terminal 22 would be coupled to the preselected biasing potential (according to the position of switch 52) via connector 32. In the above situation, a corona charge of preselected characteristics would be deposited on the surface 50 during machine operation.

After prolonged use or if the operative corona device 10 fails to perform satisfactorily, the block 15 is rotated clockwise in either sense to de-energize the previously operative corona device and concurrently energize a new or fresh device adjacent the previously operative or spent one. De-energization occurs as a result of the rotation of the block 15 during which the terminals 21 and 22 of the spent drive move out of contact with connectors 31 and 32. Concurrently, rotation of block 15 moves the contacts 21 and 22 of the new device into operative positions in contact with the energizing connectors 31 and 32.

It is thus seen that the procedure for replacing a malfunctioning or worn out corona device is substantially facilitated by simply rotating a new one into position. The resulting savings in time associated with this procedure are evident.

It is obvious that modifications of the basic charging devices of the invention are possible while retaining the inherent advantage of easy replaceability offered thereby. Thus, while the foregoing specification has described in considerable detail a typical embodiment, it will be understood that the description is illustrative in nature rather than limiting. It is accordingly intended that the scope of this invention be determined by reference to the appended claims.

What is claimed is:

1. A corona charging arrangement for depositing charge on an imaging surface comprising:

a plurality of corona discharge devices carried by a common member, each device comprising a corona electrode including a wire coated with a thick dielectric material sufficient to prevent the flow of conduction current therethrough, conductive biasing member carried by said common member, said electrode supported in contact with said biasing member, means for applying corona causing potentials to one of said devices, and means for moving said member to orient one of said plurality of devices for depositing charge on said surface.

2. The combination recited in claim 1 further including means responsive to the movement of said member for de-energizing one of said devices and energizing another of said devices.

3. The combination recited in claim 1 wherein said member comprises an elongated polygonal support including a plurality of flat surfaces disposed in planes parallel to the longitudinal axis of said support, each of said devices associated with one of said flat surfaces.

4. The combination recited in claim 3 wherein said support is mounted for rotation about said axis.

5. The combination recited in claim 3 further including means for coupling corona generating potentials to said one of said devices.

* * * * *

UNITED STATES PATENT OFFICE
CERTIFICATE OF CORRECTION

PATENT NO. : 4,056,723
DATED : November 1, 1977
INVENTOR(S) : Brian E. Springett and Dror Sarid It is certified that error appears in the above-identified patent and that said Letters Patent are hereby corrected as shown below:

Column 5, Line 38 - change "22" to "52".

Column 5, Line 68 - change "22" to "52".

Column 6, Line 15 - change "22" to "52".

Column 6, Line 41 - change "Fig. 1" to Fig. 3".

Figure 3 - change legend shown as "22" to "52".

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*